US006173598B1

(12) United States Patent
Caporusso et al.

(10) Patent No.: US 6,173,598 B1
(45) Date of Patent: Jan. 16, 2001

(54) MODULAR MULTIPURPOSE BENDING MACHINE AND ITS LINEAR POSITIONING SYSTEM

(75) Inventors: Alessandro Caporusso; Mario Caporusso, both of Frosinone; Stefano Ramandi, Ceccano; Rossano Ramandi, Ripi, all of (IT)

(73) Assignee: C.M.L. Costruzioni Meccanichi Liri S.R.L., Piedimonte San Germano (IT)

( * ) Notice: Under 35 U.S.C. 154(b), the term of this patent shall be extended for 0 days.

(21) Appl. No.: 09/358,435

(22) Filed: Jul. 22, 1999

Related U.S. Application Data

(62) Division of application No. 09/080,295, filed on May 18, 1998, now Pat. No. 5,970,770.

(30) Foreign Application Priority Data

May 23, 1997 (IT) ..... RM97A0310

(51) Int. Cl.[7] ..... B21D 7/08
(52) U.S. Cl. ..... 72/175; 72/173
(58) Field of Search ..... 72/175, 171, 173, 72/170, 442, 444

(56) References Cited

U.S. PATENT DOCUMENTS

| | | | | |
|---|---|---|---|---|
| 135,498 | | 2/1873 | Tomlinson | 72/171 |
| 1,319,503 | | 10/1919 | Yoder | 72/206 |
| 1,743,418 | | 1/1930 | Yates | 72/171 |
| 1,942,992 | | 1/1934 | Yates | 72/171 |
| 2,335,028 | * | 11/1943 | Rose | 72/173 |
| 3,540,249 | | 11/1970 | Sawyer et al. | 72/170 |
| 4,232,540 | | 11/1980 | Cain et al. | 72/173 |
| 4,391,119 | | 7/1983 | Schmitz | 72/294 |
| 5,431,035 | * | 7/1995 | Sheen | 72/173 |

* cited by examiner

*Primary Examiner*—Daniel C. Crane
(74) *Attorney, Agent, or Firm*—Young & Thompson

(57) ABSTRACT

A bending machine includes a bending head with three bender rollers, one of which is vertically displaceable with a double-acting cylinder having a cylinder body inside the bending machine frame and below the bending head. A work surface is above the bending head and provided with an opening coaxial with the double-acting cylinder. The work surface includes a support for a tool driven by the cylinder.

5 Claims, 13 Drawing Sheets

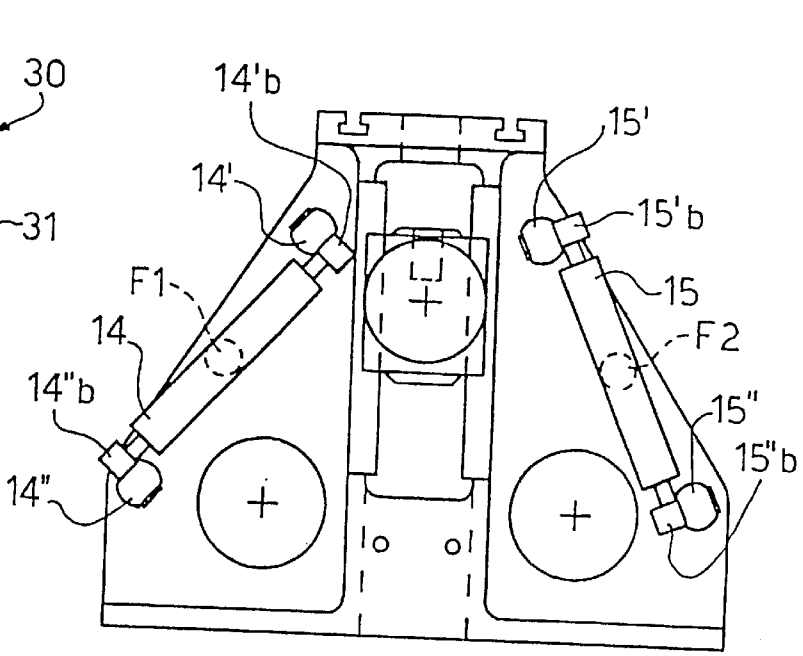
FIG. 8
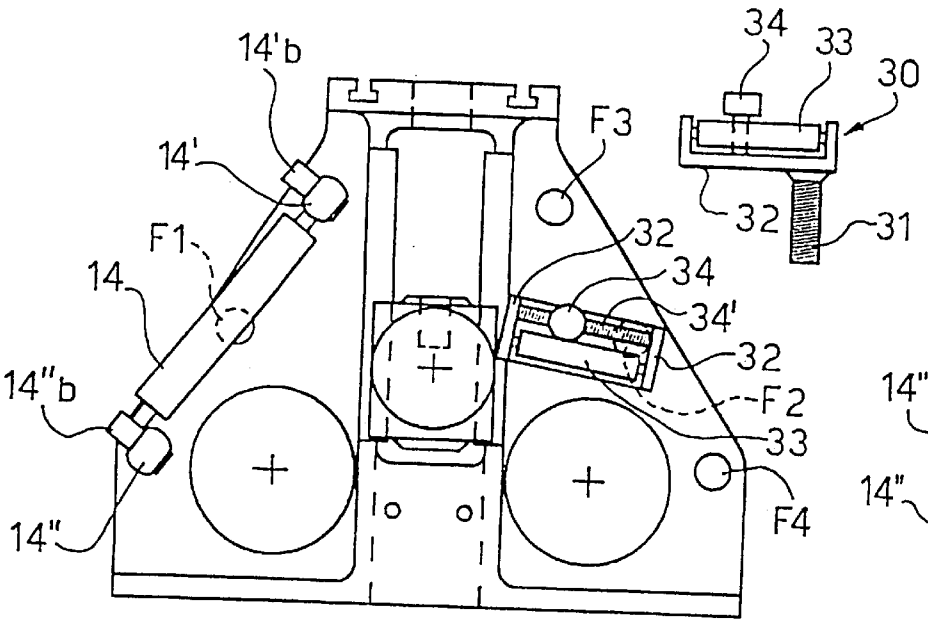
FIG. 7A
FIG. 7

MODULAR MULTIPURPOSE BENDING MACHINE AND ITS LINEAR POSITIONING SYSTEM

CROSS-REFERENCE TO RELATED APPLICATIONS

This application is a division of application Ser. No. 09/080,295, filed May 18, 1998, now U.S. Pat. No. 5,970, 770.

BACKGROUND OF THE INVENTION

This invention relates to the field of the bending machines in general, i.e. machines adapted to bend straight semifinished products having an indeterminate length and being of a constant cross-section such as pipes, rods and section bars, into plane and spatial curves, also more than a round angle, for example helically and/or spirally.

Bended pipes or section bars are largely and meaningfully used in the architectural field, both for mainly functional members, such as e.g. handrails for winding staircases and section bars for arcades, and attractive elements, such as e.g. grates, in technical systems for building, such as e.g. heating plant pipes, as well as in several industrial apparatuses such as heat exchangers.

In particular this invention concerns a bending machine comprising a frame, having a main side in which a bending head is provided including three bender rollers, whose two rollers have fixed axes of rotation, the third one having a vertically displaceable axis of rotation, as it is mounted on a slider which is movable along a vertical rectilinear guide; comprising a motor and reduction gear unit driving one or more bender rollers; comprising thrust rolls and comprising a driving cylinder of said slider.

A prior art bending machine, of the kind which this invention refers to, is perspectively shown in FIG. 1 in the accompanying drawings.

This prior art bending machine comprises a machine body, indicated by the reference numeral 1, that encloses and supports internally a motor unit of the bending machine and externally has working means. As shown in FIG. 1 (prior art), the working means comprises three grooved rollers or pulleys 2, 2', 2" which are located in a Δ (delta)-shaped configuration, having one horizontal side and two oblique sides, upon a working head 1' which is provided by a main side 1*a* of the machine body 1. (The bending machine is shown in an usual arrangement with the working head 1' in vertical position. However the working head 1' can turn in a right angle to be displaced into a horizontal position, if desired according to working necessity.) Two rolls or thrust elements or straighteners 3, 3' are mounted approaching the two oblique sides, respectively, of delta-shaped configuration of the grooved rollers.

Arranged inside the machine body as abovementioned is a motor unit that gives the working head a torque. The motor unit comprises an electric motor that through a reduction gear rotates two toothed wheels that in turn rotate the two first rollers 2, 2'. The electric motor is located approaching the working head, i.e. the main side of the bending machine; the reduction gear, connected to the output of the motor, approaches the side of the bending machine which is opposite to the main one, or rear side. Meshed on the reduction gear are three sprockets that are driven by the motor through the reduction gear, and in turn drive the three bender rollers through respective pairs of universal joints. (In order to bend with only two instead of three rollers, the third roller can be removed from its meshing. In order to bend semifinished products with an aesthetical aim, two power-driven rollers or trailer rollers or forming rollers are required, in this case they being provided with a knurl to catch the semifinished product and thus draw it in the bending phase.)

In operation, a pipe or section bar is feed among the three grooved rollers and the trailer ones of said rollers are rotated. The thrust rolls operate to give the semifinished product being worked an axial pitch of a helicoidal spatial bending, outside the bending plane which is defined by the delta-shaped configuration of the three grooved bender rollers. The thrust rolls work by exerting a thrust force on a pipe or section bar or rod that is feed during the bending operation.

The bender roller, which is located in the apex opposite to the horizontal side of the delta-shaped configuration, the third roller—as opposed to the other two rollers, the first one and the second one—indicated by reference numeral 2", is mounted on a saddle or slider 2"a, that can be stopped in a vertically adjustable working position. As the third bender roller is displaceable along the vertical direction, its position can be adjusted in relation to the other two bender rollers, i.e. the distance between the axes of the bender rollers can be adjusted. This allows the radius of curvature to be changed in a bending operation.

A hydraulic cylinder 4 usually is provided in order to carry out linear displacements of the slider 2"a. The cylinder 4 is mounted on a shelf 4*a'* upon a horizontal ridge plane of the main side 1*a*. The cylinder 4 usually is assisted by its own drive motor (not shown). (Further, a low cost screw-type manual driving device, mounted on the same shelf 1*a'*, can be provided instead of cylinder 4).

Thee bending machine is equipped with a control keyboard.

This invention starts from the following.

Both, the shelf 4*a'* on the main side 1*a* of the bending machine and the hydraulic or pneumatic or oleodynamic cylinder 4 arranged on the shelf, are limited to their specific function, i.e. to carry out the linear displacements of the slider 2"a bearing the third roller 2". In fact, the shelf plane is not available because it is occupied by the body of hydraulic cylinder; further, the positive displacements of the cylinder rod cannot be used differently for other purpose, as the cylinder rod works downward and therefore cannot cooperate with an user device.

On the contrary, it would be very advantageous that the shelf plane was available and the positive displacements of the cylinder rod, that can exert pressure as great as 12 (twelve) tons, could be utilized. In this way a tool could be installed onto the shelf and driven by the hydraulic cylinder, thus adding functions to the bending machine.

From this point of view, the same motor unit of the bending machine can be suitably utilized for the primary motion of a tool. In the prior art arrangement of the motor unit, a tool outside the bending machine cannot utilize the torque delivered by the motor unit.

On the contrary, the use of this torque would be also very advantageous, as the bending machine, with the only and the same motor-driving of principal bending means, would be able to mount and drive further tools, in particular tools able to operate on the same type of semifinished product (pipes, section bars, rods) on which the bending machine is designed to work, said further tools being driven both by a thrust (such as a thrust exerted by the abovesaid hydraulic cylinder) and a torque (such as a torque drawn from the motor unit).

Thus, a general object of this invention is to provide a bending machine of the abovementioned type, in which the driving units can be utilized to operate tools outside the same bending machine.

In particular, an object of this invention is to provide a bending machine so that it can sustain a tool upon the shelf provided by its main side and operate said tool by utilizing the positive displacements of the rod of the hydraulic or pneumatic or oleodynamic cylinder.

Such an object is achieved according to the teaching of present invention by the following expedient.

The hydraulic driving cylinder is not installed above the shelf, rather below the shelf, suitably housed in the machine body. The shelf so cleared is provided with connection means for a tool, thus becoming a connection shelf.

A bending machine with such capacities has an advantage to be modular, i.e. it can be considered a basis unit on which a different tool can be installed from time to time. E.g. a countersink, a punching tool, a drawing die, a trimming tool etc. is able to be installed on the bending machine, all being driven by the thrust of the pre-existent hydraulic cylinder. Thus this machine, besides being a real bending machine, is also a multipurpose machine.

This advantage is important particularly in that functions strictly pertaining to pipe and section bar working can be added to bending machine so that one machine is available to carry out a number of operations on pipes and section bars. Firstly a bending machine would become also a thrust pipe bender. One really may think to install on the connection shelf a tool provided with a structure adapt to support idle counteracting rollers on the one side and on the other side with respect to a vertical axis. This vertical axis of said structure has to be coincident, when said tool is mounted on the connection shelf, with the axis of the linear displacements of the rod of the hydraulic or pneumatic cylinder. Thus, a thrust means adapt to sustain a pipe, such as e.g. a half-moon shaped grooved rest, can be connected onto the free end of the cylinder rod in order to bend a pipe against the abutment of said counteracting rollers.

A yet greater advantage would result from a bending machine also being able to carry out functions useful to preparation for a bending operation. A pipe throughout a bending operation is considered in the following. Referring to FIG. 2 of accompanying drawings—in which it is shown schematically how e.g. a pipe is affected during a bending operation—a pipe P is feed to the space among three rollers $R_1$, $R_2$, $R_3$, into the respective grooves thereof. The pipe P separates the rollers $R_1$, $R_2$ on the one side from the only third roller $R_3$ on the other side with respect to a line of extension of the pipe P. The pipe P, in the bending operation, has an end cross-section of entrance P' and an end cross-section of exit P". If now one considers those generating lines that are tangent to circumference of second roller $R_2$ and circumference of third roller $R_3$, he can see generating lines touching the second roller in a point p' and the third roller in a point t', respectively. Then, if he considers generating lines tangent to circumference of first roller $R_1$ and circumference of third roller $R_3$, he can see generating lines touching the first roller in a point p" and the third roller in a point t", respectively. The pipe P is bent on the third roller only within the circumferential length defined by the points t' and t", i.e. the arc of circumference t't". From a result of this analysis, it follows that at the beginning of curving operation, when the pipe P is feeding to the bending head, its end of entrance P' reaches the tangent point p', the curving begins, but only in the length of pipe lying on the arc t't". Thus, if the pipe cross-section coincident with t', when P' is coincident with p', is indicated as T', as a result the leading length P'T' is not curved, but it remains straight. Similarly, at the finish of a curving operation, when the pipe P is exiting from the bending head, its end of entrance P" reaches the tangent point p", the curving terminates. As the curving is limited to the length of pipe lying on the arc t't", if the pipe cross-section coincident with t", when P" is coincident with p", is indicated as T", as a result the tail length P"T" remains straight. As a consequence of this, a pipe P curved according to a round angle, as shown in FIG. 2A, has a leading length P'T' and a tail length P"T", that remain straight. Thus an operator has to cut off these lengths and weld new ends so obtained, with waste of material and time.

SUMMARY OF THE INVENTION

In order to overcome this drawback, then it is suitable to pre-curve as preparation the ends of a pipe to be curved. To this purpose one can use a pipe press, as shown in a front view in FIG. 3 of accompanying drawings. The pipe press comprises a die 20*a* and a counter-die 20*b*, both being shaped into a form of a saddle, convex and concave, respectively. Then, in a bending machine according to the present invention the pipe press may be mounted on the connection shelf and the die 20*a* may be driven onto the counter-die 20*b* under the drive force of the rod 34*b* of the hydraulic cylinder, the die being mounted on the rod 34*b* by means of a suitable sleeve 34*b'*.

Another great advantage, yet with respect to the bending e.g. of a pipe, is obtained when giving a helix pitch to the pipe. As abovementioned, the helix pitch is obtained through the counteracting effect on a pipe in bending operation by the thrust rolls 3, 3' with reference to FIG. 1. These thrust rolls are fixedly sustained by means of supports, which permit a certain interval of changeability in the positioning of the same thrust rolls. However, once fixed the thrust rolls, they are not changeable in position during the bending operation. However, a change in their position might be achieved if such thrust rolls were mounted on rods of hydraulic cylinders controlled in their extension through the same electric apparatus which controls the other means of the bending machine. Since the abovesaid shelf is clear, then a thrust roll can be mounted on a hydraulic cylinder horizontally installed on the same shelf.

Another object of the present invention is to provide a bending machine of the above discussed type, in which the torque delivered by the electric motor, driving the bending rollers, can be utilized by tools outside the same bending machine.

This object is achieved by the following expedient. The reduction gear designed to transmit the torque delivered by the electric motor is arranged approaching not the rear side of the bending machine, but the front side, i.e. the main side. Thus the reduction gear is directly meshed with two toothed wheels inside the machine body—integral with shafts outcoming externally to the main side—on which the first and the second bender rollers are mounted, according to the above terminology. One of two said toothed wheels has a seat that engages a shaft by means of a friction clutch. This shaft, which rotates in this way by the electric motor, transmits its movement to another shaft having two universal joints, through a pair of gears arranged near the rear side of the bending machine. The shaft, having two universal joints, transmits its rotary movement to the third bender roller. (The third roller can be power-driven or not.) Thus two drives of rotary movement approaching the rear side are available: those presented by the so arranged ends of the two shafts described, i.e. the drive provided with a friction clutch and the drive having two universal joints for the third roller. Then, means drawing these torques and bringing them outside the rear side can be mounted.

Very advantageously, these two drives of rotary movement can operate e.g. two countersinks, male and female threaded cone-shaped respectively, in order to carry out the countersink of pipes.

Therefore, it is an object of the present invention a bending machine comprising a frame, having a main side in which a bending head is provided including three bender rollers, whose two rollers have fixed axes of rotation, one roller having a vertically displaceable axis of rotation, as it is mounted on a slider which is movable along a vertical rectilinear guide provided by a bending head; comprising a motor and reduction gear unit driving one or more bender rollers; comprising thrust rolls, and a double-acting cylinder with a driving rod of displacement of said slider, wherein said cylinder has its cylinder body mounted inside said frame below said bending head, and a work surface, thus remaining free on said main side above said working head, is provided with means adapted to support a tool on said work surface as well as with an opening for the interface connection of this work surface to mechanical members of the same bending machine.

According to the invention said bending machine is equipped with a reduction gear, operating at two or more speeds, designed to be mounted on said free work surface and provided with means for the mechanical interface connection to said slider supporting said third bender roller in order to drive the displacements thereof along its vertical guide upon a manual control.

A bending machine according to the invention is provided with means for making available a push/pull force of the rod of said double-acting cylinder in said work surface on the main side above the bending head.

A bending machine according to the invention is equipped with a mechanical working tool comprising a die and a counter-die, one of which is provided with means adapt to receive the push/pull of said double-acting cylinder made available on said free work surface.

In a bending machine according to the invention said motor and reduction gear unit drives the two fixed bender rollers by meshing one of its toothed wheels with two toothed wheels integral in rotation with the axes of the fixed bender rollers respectively, said wheels being mounted approaching the internal side of the bending head, and one of said wheels is provided with a friction clutch means for the connection to the one end of a transmission shaft, having, near its other end sustained by a removably support to said frame, a toothed wheel meshing with another toothed wheel, whose spindle is mounted on a support removably connected to said frame on the one hand and connected on the other hand by an universal joint to another transmission shaft, which in turn is connected with an universal joint to another spindle integral in rotation with said third bender roller, in order to transmit optionally, by means of modular parts mounted on a basis configuration of a bending machine, the rotary movement from said motor and reduction gear unit to the third bender roller.

In a bending machine according to the invention said supports and said frame have through holes correspondently in each other, and said transmission shaft and said spindle of toothed wheel are extended in said through holes to serve as drives of rotary movement for a rotary tool.

A bending machine according to the invention further comprises two series of three holes respectively on the two sides of a triangle, whose base is defined by the two fixed bender rollers and the apex of which is defined by the third bender roller, in order to mount supporting means of thrust rolls.

A bending machine according to the invention further comprises supporting means of thrust rolls, including eyebolt-type supports, each having longitudinally a through hole designed to receive a small cylinder, in which through holes are carried out transversally to receive end pins supporting thrust rolls, in order to provide many sloping positions for the thrust rolls on the bending head.

A bending machine according to the invention further comprises a support for a thrust roll with a screw to be mounted in one of the holes of said series of holes and a connection means to mount a thrust roll.

Further, it is an object of the present invention a bending machine as described, also characterized in that it is equipped with detection means of the position of said supporting slider of the third bender roller along its guide in the bending head, and with a control unit connected to said cylinder and said motor and reduction gear unit and a control switchboard and comprising an electronic control card, including means adapt to code a position along an axis, entry means of commands set by means of said control switchboard and inputting and storing means of a bending program.

BRIEF DESCRIPTION OF THE DRAWINGS

This invention will be best understood from the following detailed description of its preferred embodiment, made only by example but not in limiting way, with reference to the accompanying drawings, in which:

FIG. 1 shows in a perspective view a prior art bending machine, of the type which this invention refers to;

FIG. 7 shows the same with a thrust roll eccentrically mounted and with an adjustable support for the thrust roll;

FIG. 7A shows in a side view the adjustable support in FIG. 7;

FIG. 8 shows in a front view a bending machine according the present invention with the thrust rolls eccentrically mounted;

DESCRIPTION OF THE PREFERRED EMBODIMENTS

Figure 1:
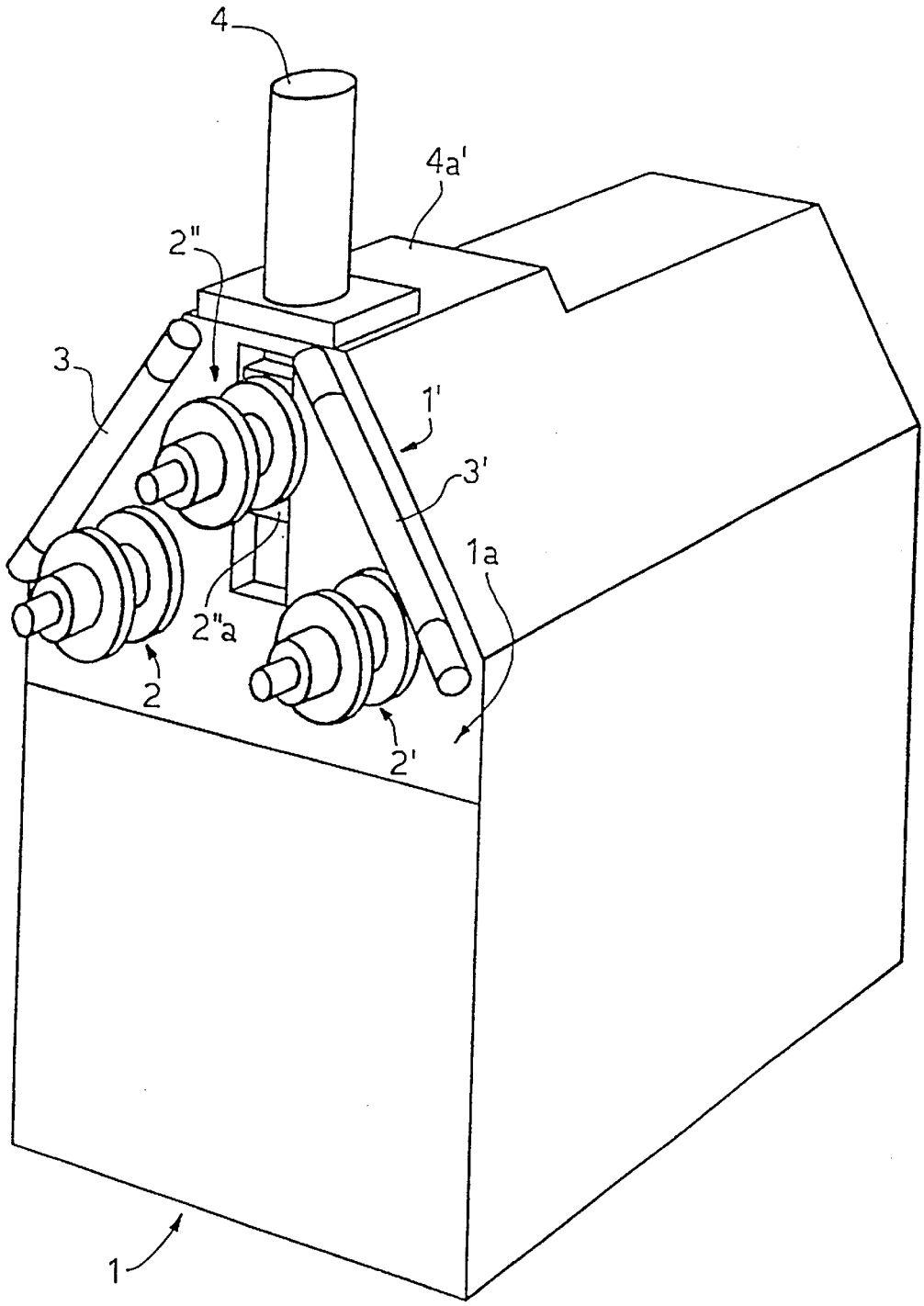
FIG. 1 PRIOR ART
Figure 2:
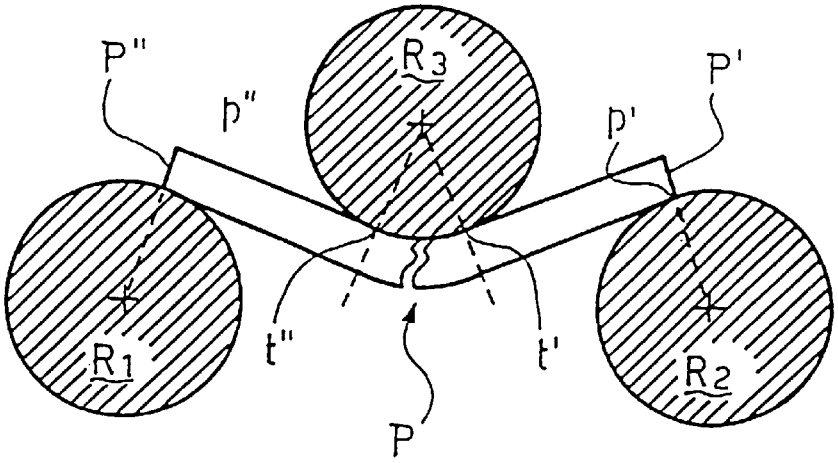
FIG. 2 PRIOR ART
FIG. 2 shows, as abovementioned, schematically a curving operation of a pipe by a bending machine as above.
Figure 2A:
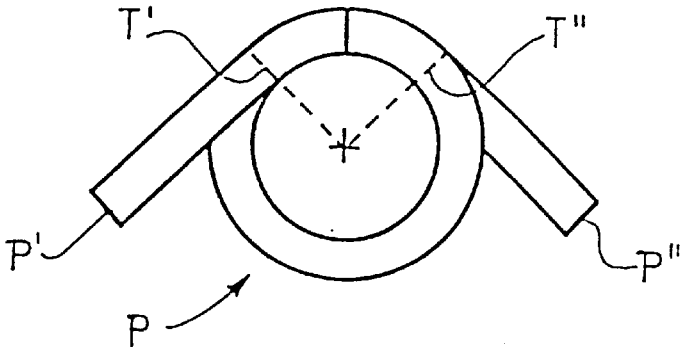
FIG. 2A PRIOR ART
FIG. 2A shows, as abovementioned, the curving result of a pipe by a bending machine as above.
Figure 3C:
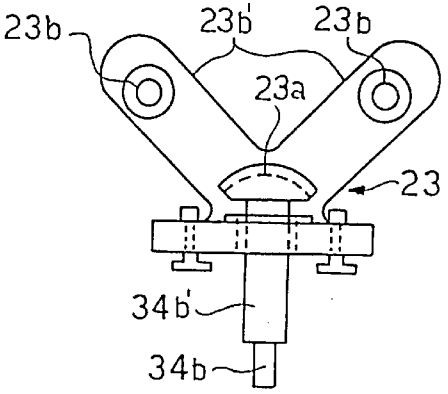
FIG. 3C shows in a front view a thrust pipe-bender head which can be mounted on a bending machine according to the present invention.
Figure 3D:
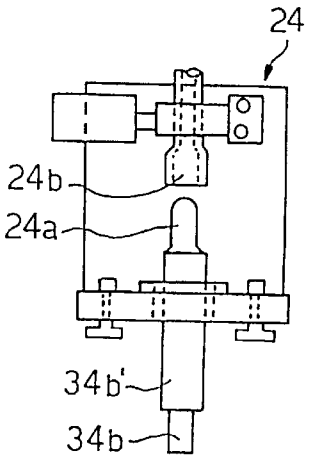
FIG. 3D shows in a front view a drawing die or a tapering tool which can be mounted on a bending machine according to the present invention.
Figure 3:
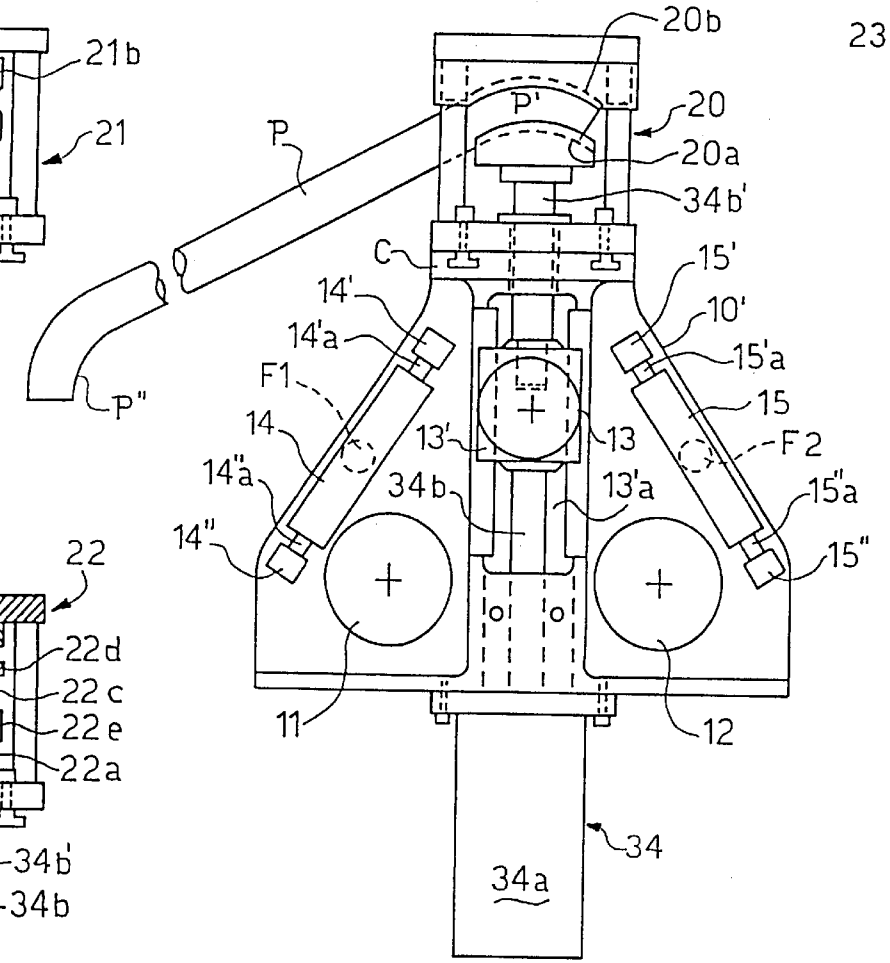
FIG. 3 shows in a front view a bending machine according to the present invention in which a forming tool adapt to prepare a pipe to a bending operation is mounted.
Figure 9:
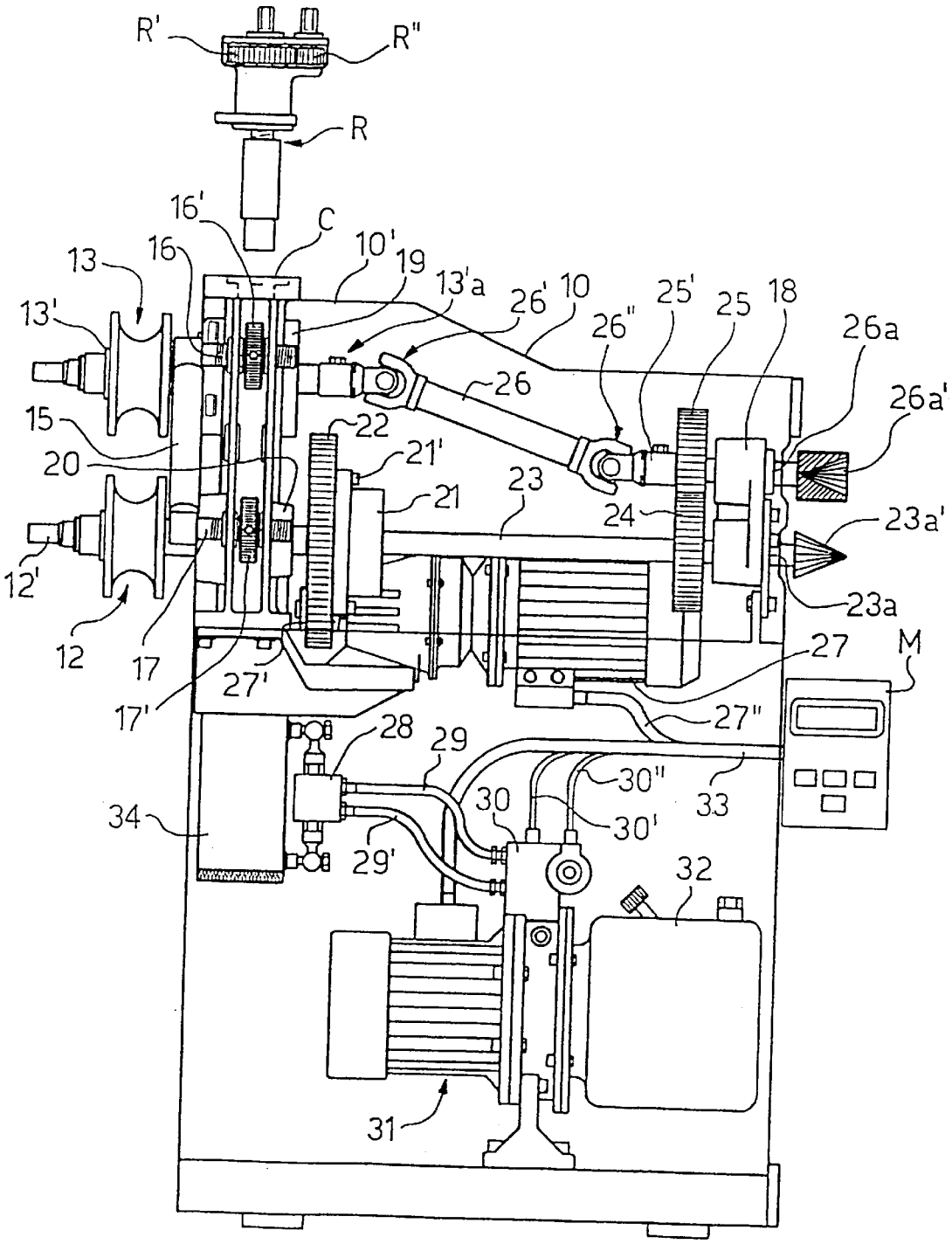
FIG. 9 shows in a longitudinal section view a bending machine according the present invention to represent the internal construction, including a reduction gear for manually approaching the third roller.

Firstly referring to FIG. 3 and FIG. 9, a construction of a bending machine according to the teaching of this invention is shown. FIG. 3 shows it frontally; FIG. 9 shows its internal construction. The bending machine comprises a frame 10 which both houses and supports working members. The frame 10 has a configuration such that it has a front, main side 10', in a frontal portion of which a working head is provided. The working head includes three bender rollers 11, 12 and 13. Each of two rollers 11 and 12 is stationary on its driving shaft, and said third roller 13 is mounted on a slider 13' which is able to be positioned along a vertical guide 13'*a* by means of a rod 34*b* of a hydraulic or pneumatic cylinder 34. Cylinder body 34*a* is arranged below the working head at shown in FIGS. 3 and 4, i.e. the cylinder rod 34*b* exerts its driving thrust upwardly.

Figure 5:
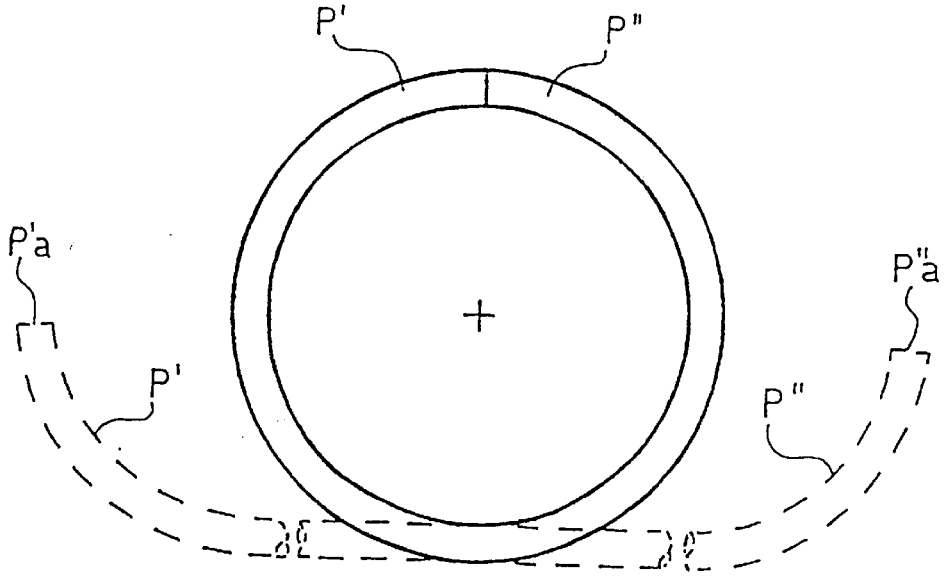
FIG. 5 shows a curving result of a pipe preformed by the forming tool in FIG. 3.
Figure 6:
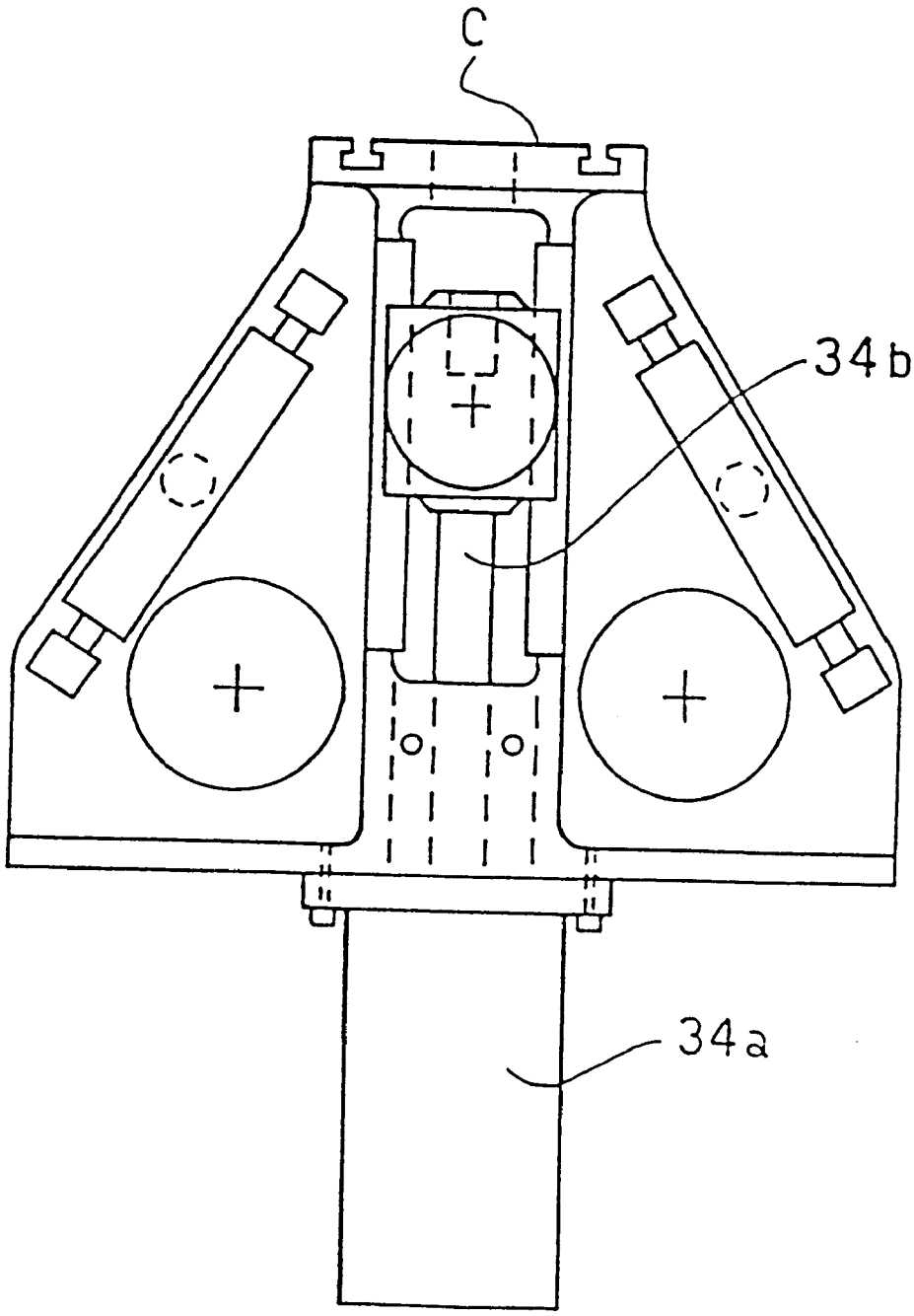
FIG. 6 shows in a front view a bending machine according to the present invention with thrust rolls mounted in a normal way.

As a result of this arrangement on the main side 10' a surface C above the working head is free, as best shown in FIG. 5. Further this surface C is crossed by the displacement axis of the hydraulic double-acting cylinder 34, above the cylinder and in direction of the rod thrust. This positive thrust can be used to drive a tool which the bending machine is equipped with.

In FIG. 3 a forming tool for pre-curving a pipe P is shown mounted on the bending machine, pipe ends P', P" being already formed and the tool yet engaging pipe end P'. The tool indicated generally with the reference numeral 20 and mounted on the work surface C comprises a die 20*a* driven by the cylinder rod 34*b* and a fixed counter-die 20*b*, both being shaped into a form of a saddle, convex and concave, respectively. The tool is shown with the die receiving the upward thrust of the cylinder rod 34*b* through suitable interface connection means 34*b*' with the rod, the pre-curvature being concave downwardly. However, an inverted mounting can be provided with the die working downwardly as being driven by the pull of the rod, with the pre-concavity upwardly in order to prevent interference with the machine body.

Figure 4:
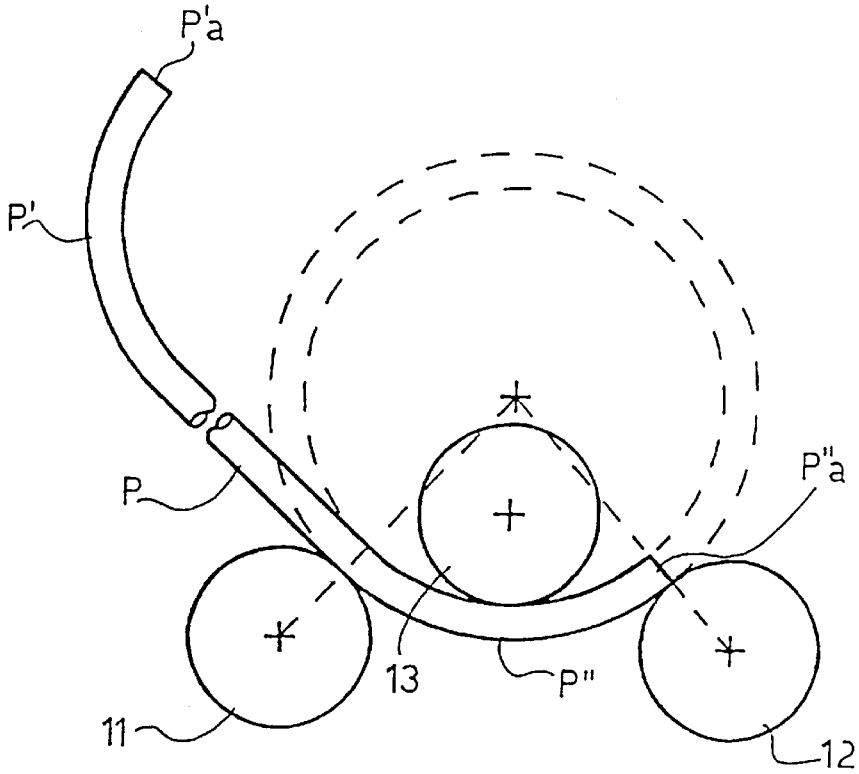
FIG. 4 shows a bending operation on a pipe which has been preformed by the forming tool in FIG. 3.

Referring to FIGS. 4 and 5, therein is shown the pipe P with its ends being curved and the pipe P curved, respectively. End lengths, that the three bender rollers cannot form, are already formed, the end cross-sections P'a and P"a matching when the pipe is closed into a circonferential shape.

Figure 3A:
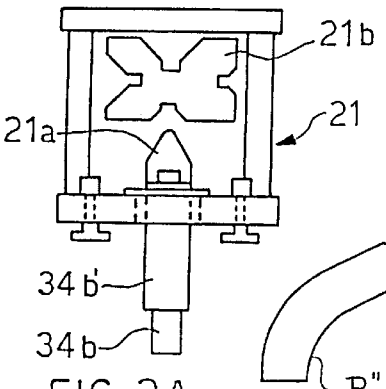
FIG. 3A shows in a front view a pressing-bending tool to curve lengths of section bars which can be mounted on a bending machine according to the present invention.
Figure 3B:
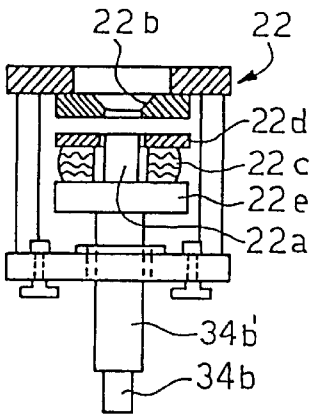
FIG. 3B shows in a front view a punching tool which can be mounted on a bending machine according to the present invention.

Referring to FIGS. 3A, 3B, 3C e 3D, therein are shown as many tools which can be advantageously used particularly in connection, with bending operations. In FIG. 3A is shown a pressing-bending tool 21 adapted to bend lengths of section bars, comprising a punch 21*a* driven by the cylinder rod 34*b* through interface connection means 34*b*', and a counter-die 21*b* having variously shaped recesses. In FIG. 3B a punching tool 22 is shown, having a punch 22*a* with an interface connection means 34*b*' with the cylinder rod 34*b* in order to receive the thrust, the punch 22*a* passing through a blank holder plate 22*d* which is spring charged by a spring 22*c* abutting a plate 22*e*. In FIG. 3C a pipe bending thrust head 23 is shown with a matrix 23*a* driven through the interface connection means 34*b*' by the cylinder rod 34*b* and two counteracting rolls 23*b* on two respective wings 23*b*'. In FIG. 3D a drawing tool 24 is shown with a die 24*a* driven through the interface connection means 34*b*' by the cylinder rod 34*b* and a counter-die 24*b*.

With reference to FIG. 9, therein are shown a manual reduction gear, mounted on the work surface C and adapted to approach the third roller, having toothed wheels R' and R", and suitable mechanical interface connection means.

Referring now to FIG. 9, therein is shown a portion driving the working head. This portion comprises a motor and reduction gear unit 27 having a toothed wheel 27' as a drive in rotary movement. The toothed wheel meshes with two toothed wheels (one of which, indicated as 22, is shown), integral in rotation with supporting shafts of bending rollers (two of which, indicated as 12' and 13', are shown).

The spindles supporting the toothed wheel 22 and the twin toothed wheel thereof are mounted on the frame 10 through a support 20 and a twin support thereof.

In a low cost basic configuration, in which only two power-driven bender rollers are sufficient, there are not other drive members. However, the present invention provides a modular construction which allows that driving members of the third roller are added to it, in order to carry out also attractive works, by virtue of the fact that, with three power-driven rollers, i.e. trailer rollers, not knurled rollers can be used to correctly trail a semifinished product.

The construction is described in the following. The toothed wheel 22 is provided with friction clutch means 21, 21' through which one end of a transmission shaft 23 of rotary movement is connected to the toothed wheel 22, another toothed wheel 24 being supported on the other end of the transmission shaft 23. The toothed wheel 24 meshes with a toothed wheel 25 mounted on a spindle 25' parallel to the shaft 23 and connected through an universal joint 26" to a shaft 26 connected in turn through an universal joint 26' to another spindle 13'a integral in rotation with a spindle 13' on which a third roller 13 is mounted.

The construction with two universal joints allows to transmit the rotary movement of the motor and reduction gear unit to the displaceable spindle of the third roller.

The shaft 23 and the spindle 25' are sustained by a support 18 mounted onto the frame 10.

The spindle 13'a is mounted on the frame through a support 19.

In the bending machine according to the present invention the rotary movement of these two shafts can be drawn from beyond the support 18 and outside the frame 10 by means of suitable through holes. Thus rear drives 26*a*, 23*a* are achieved, i.e. in the part opposite to the working head. These drives can be used to operate rotary tools. In FIG. 9 e.g. two female/male cone-shaped deburring tools 26*a*', 23*a*' are shown.

By virtue of the modular construction of this machine, the power unit of the third roller is easily mounted/dismounted, particularly in relation to the supports 18, 19 and 20.

The body of the hydraulic cylinder 34 and a hydraulic control unit 31 with a tank 32 are housed in the inferior part of the machine. The hydraulic cylinder 34 is connected to a controlled check valve 28, which in turn is connected to a change-over valve 30 by wires 29, 29'. The change-over valve 30 and the motor and reduction gear unit 27 are electrically connected by wires 30', 30" and 27" respectively to a wire 33 for the electric connection between the unit 31 and a control switchboard M to be described in detail below.

The working head further has thrust rolls 14, 15, as shown in FIG. 3. The thrust rolls 14, 15 are mounted on supports 14', 14" and 15', 15" in their ends respectively, in which they are inserted through pins 14'a, 14"a and 15'a, 15"a respectively.

On the working head, however holes F1, F2 are made in the middle way between those holes in which the supports 14', 14" and 15', 15" are mounted, in order to perform a central mounting of the thrust rolls, as described below.

Referring again to FIG. 9, therein is shown how the thrust rolls are mounted. Similarly to the thrust roll 15, they have supports mounted on adjusting screws of the distance from the front surface of the working head 16, 17 which can be set through small wheels 16', 17'.

Referring now to FIG. 7, therein is shown a modified arrangement of the thrust rolls. The supports 14', 14" are conformed as eyebolts, inserted in which are small cylinders 14'b, 14"b provided with a series of through holes. A thrust roll is mounted by inserting the end pins in holes of said small cylinders. In this way an end pin can be inserted e.g. out of the support, performing a number of position. In FIG. 7 e.g. an end pin is inserted in the support 14' and another pin is inserted in the small cylinder 14"b outside the support 14".

In FIG. 8 the thrust rolls are shown in differently sloping positions. The thrust roll 14 is mounted in the small cylinder 14'b, 14"b with both the ends outside the supports 14', 14", at opposite sides with respect to the axis for the same supports. Similarly, the thrust roll 15 is mounted with inverted ends in the-orientation with respect to the axis for the supports 15', 15".

In FIG. 7A a modified supporting means for a thrust roll is shown. It comprises a mounting screw 31, a connection element 32 adapt to support a thrust roll 33 and another thrust roll 34 mounted perpendicularly to the thrust roll 33 for L-shaped bars, on a adjustable screw 34' passing through it. The screw 34' can rotate by a nut (not shown) in order to move forward/backward the thrust roll 34, which further has a screw for its adjustment in height. The support 30 is pivoted into the hole F2.

Figure 10:
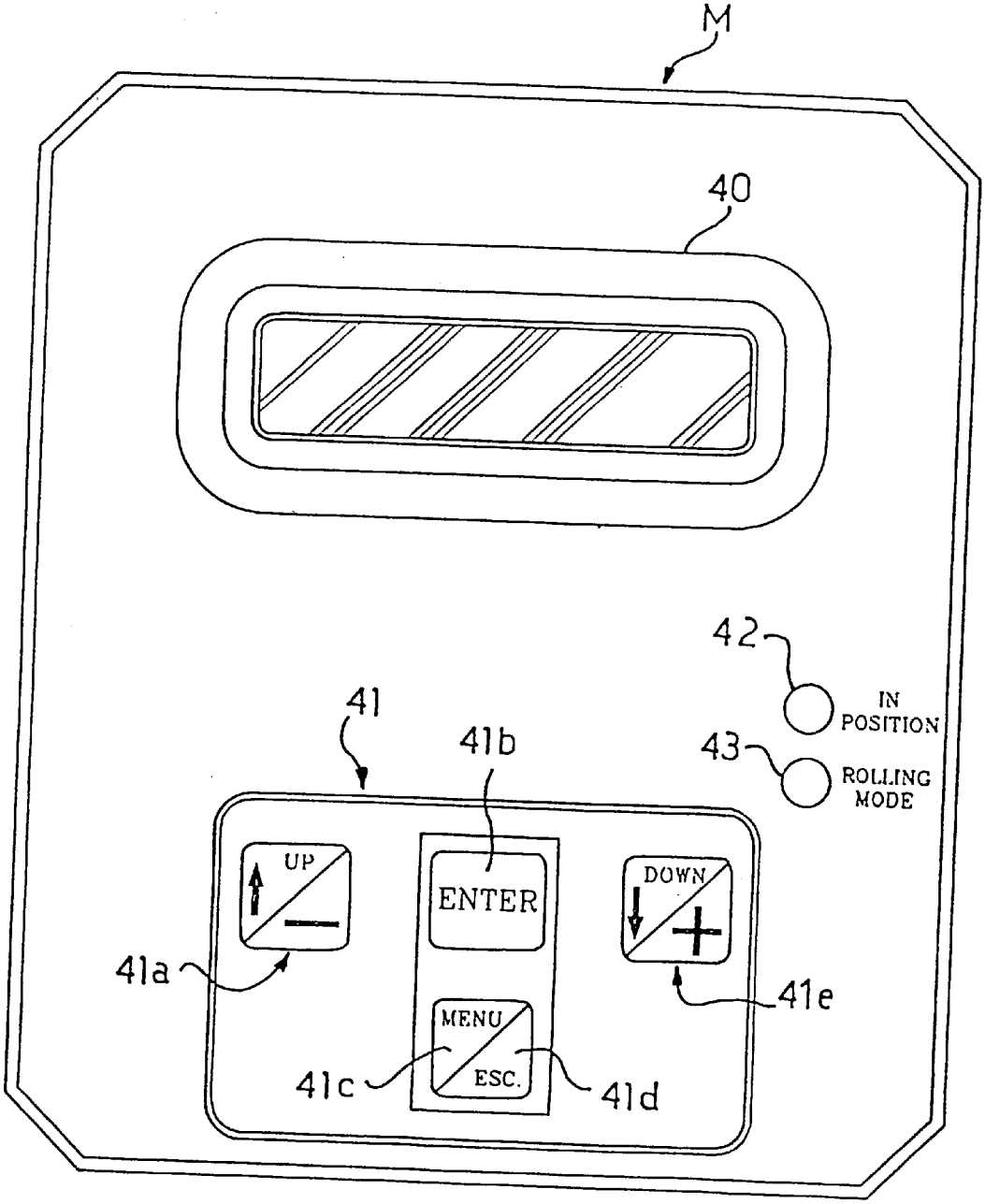
FIG. 10 shows a control panel for a bending machine according the present invention.
Figure 11A:
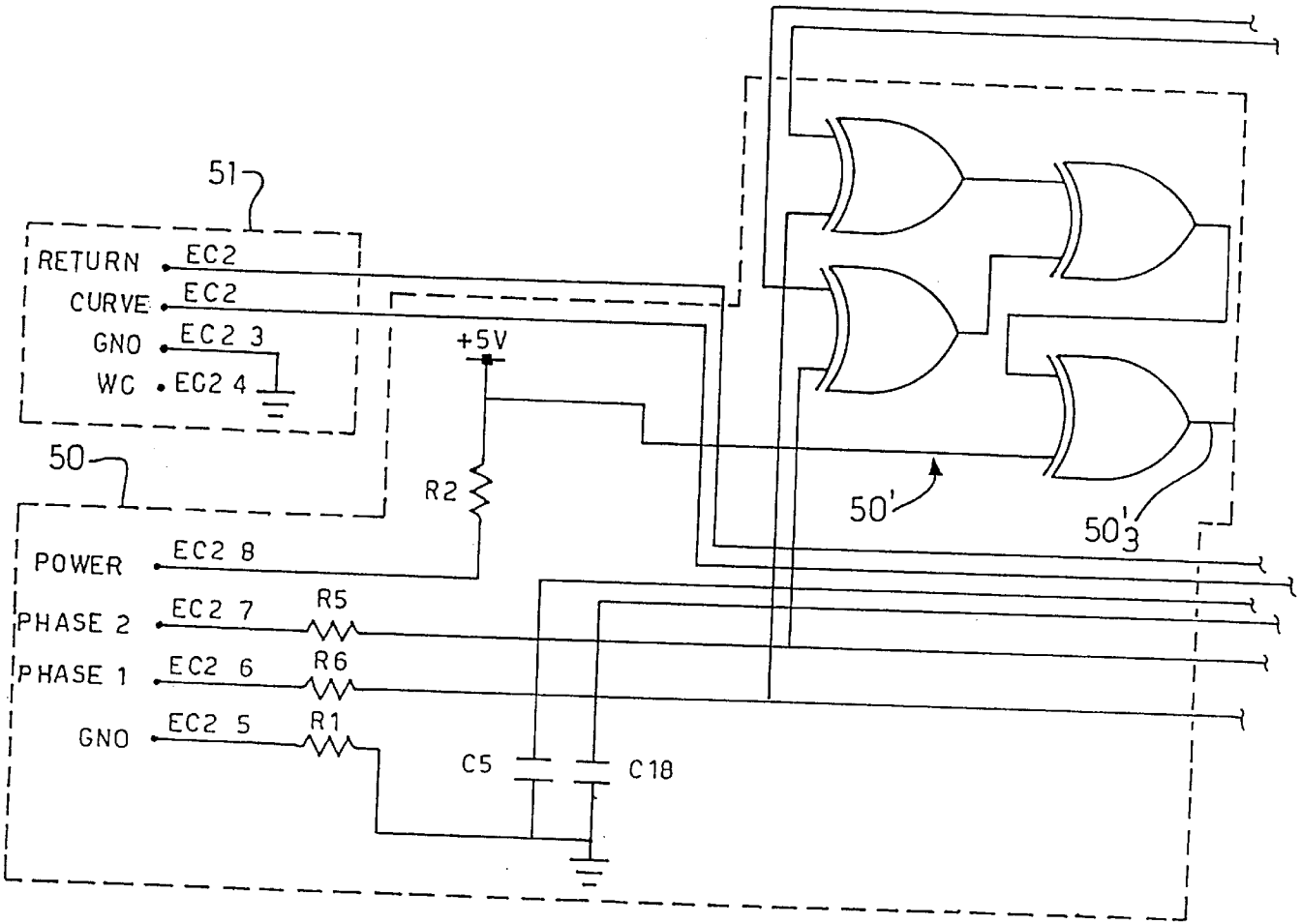
FIGS. 11 A–D show a circuit diagram of a linear positioning system for a bending machine according the present invention.
Figure 11B:
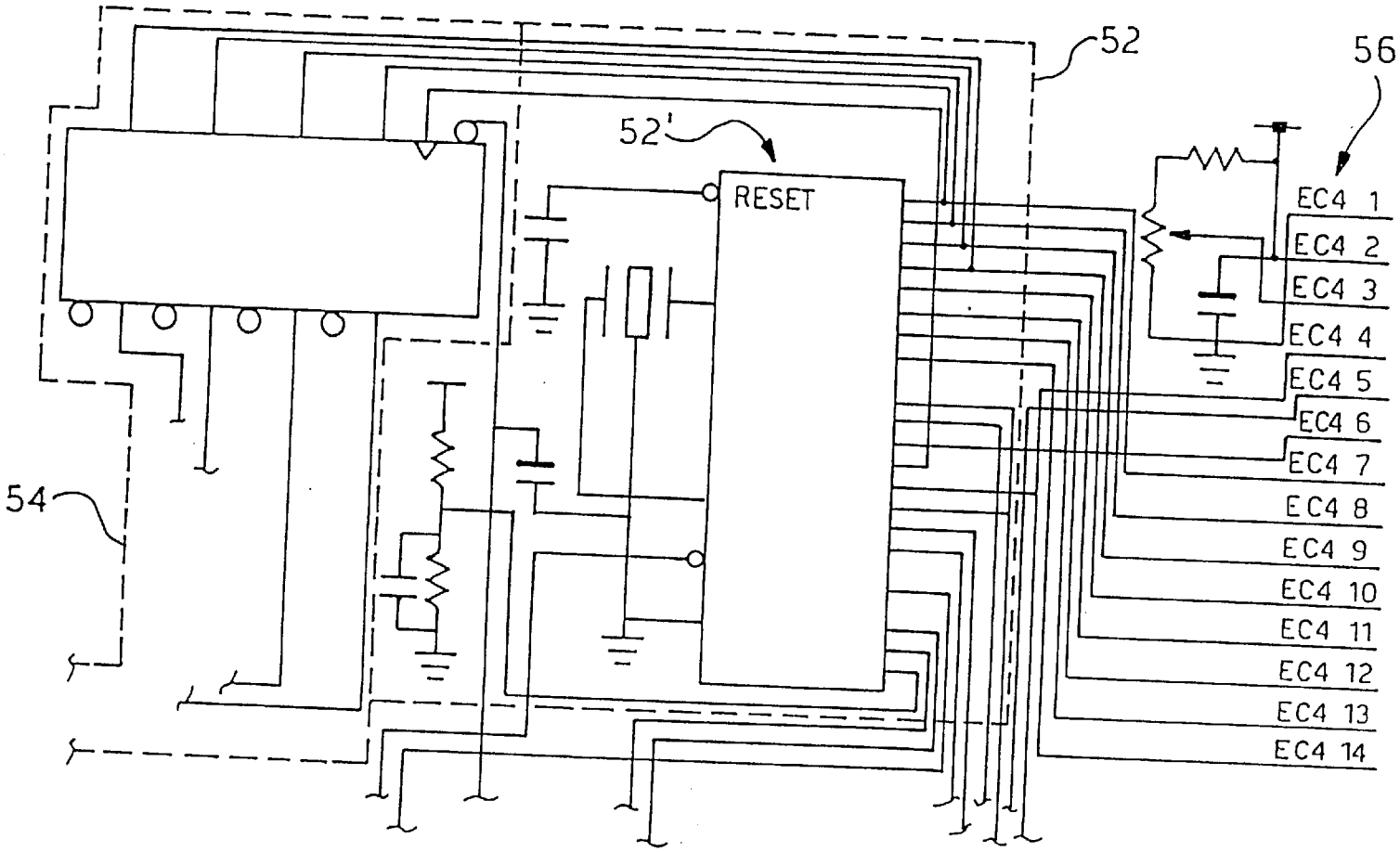
Figure 11C:
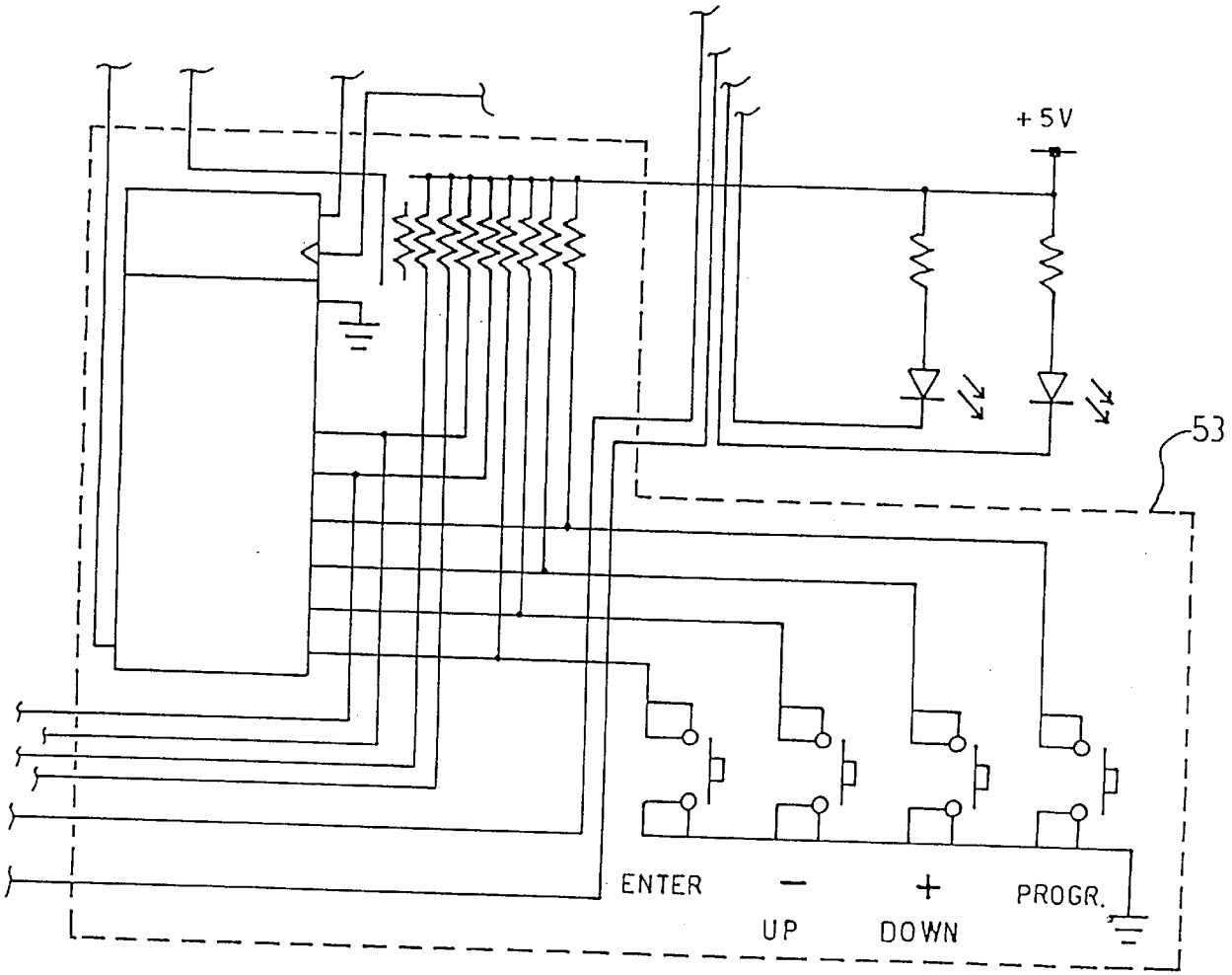
Figure 11D:
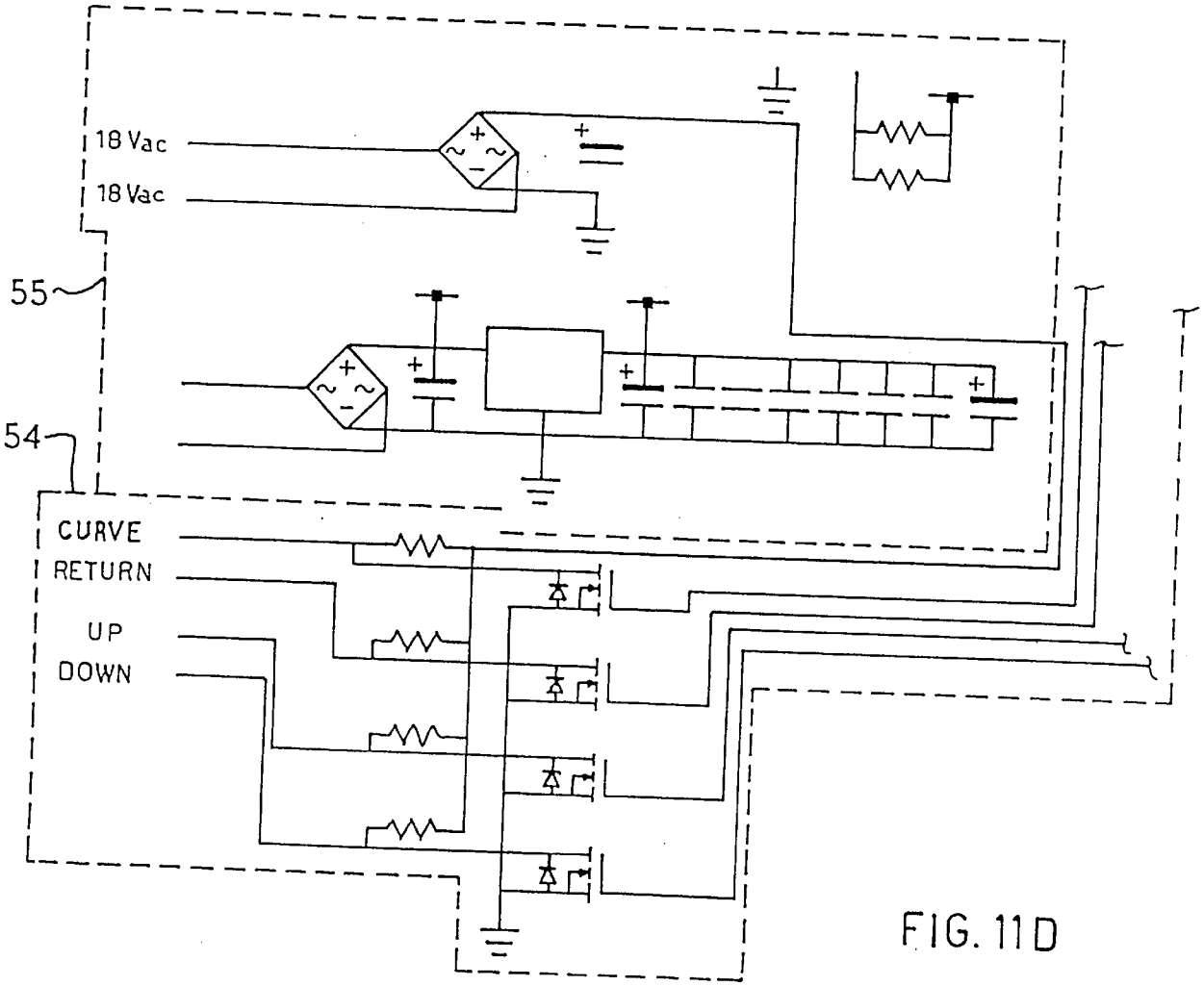

Referring now to FIG. 10 therein is shown in detail the control switchboard M above mentioned. It comprises a liquid cristal display 40, a small keyboard 41 and two push buttons 42, 43, the former for the initial position ("IN POSITION"), the latter for the bending mode ("ROLLING MODE"). The small keyboard 41 includes sliding keys upward ("UP/–") 41*a* and downward ("DOWN/+") 41*e*, as well as an enter key ("ENTER") 41*b* and a menu key ("MENU") 41*c* and an exit key ("ESC.") 41*d*.

Referring to FIGS. 11 A–D, therein is shown a diagram of the circuit components for the control switchboard. It is intended that it serves to control a linear displacement of the slider on which the third bender roller is mounted.

Figure 13:
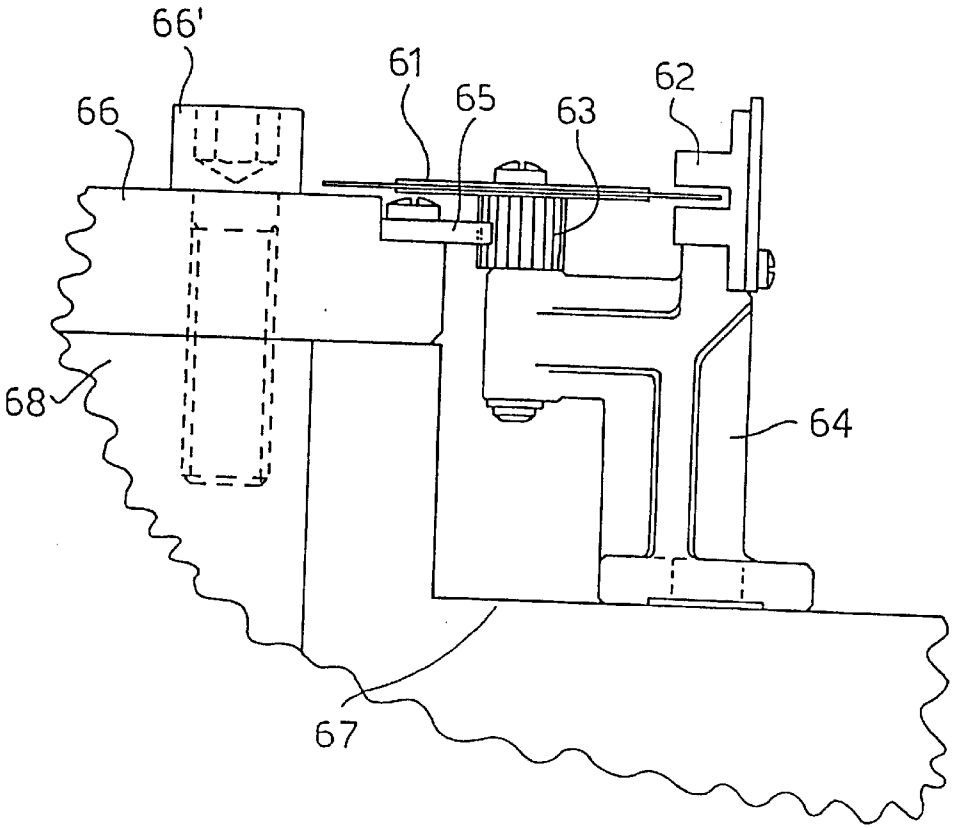
FIG. 13 shows the same in a plan view from below.
Figure 12:
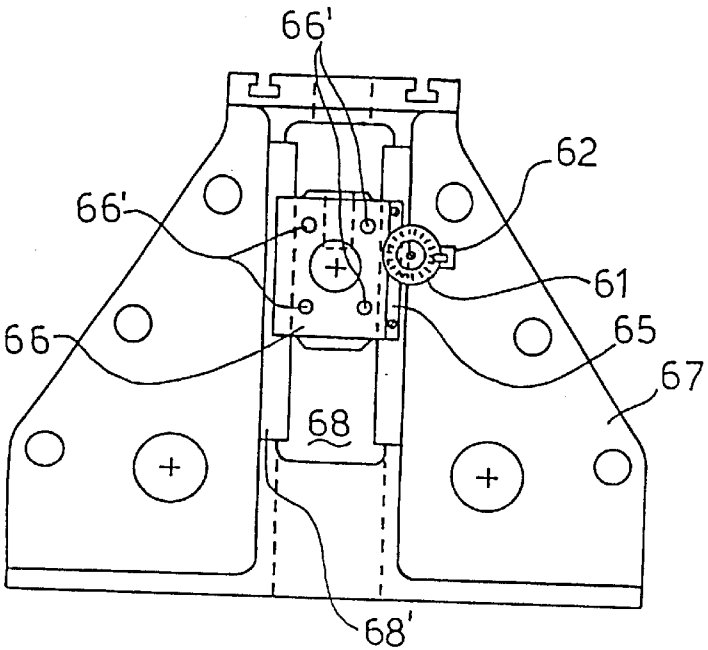
FIG. 12 shows in a front view a detection system for a linear positioner of the third bender roller.

Referring to FIG. 12 and FIG. 13, therein is shown a detection system that is used in connection with said linear positioning system. The detection system, which is provided on a bending machine having a main side 67, comprises a photoelectric counter connected to a motion sensor for the linear displacement of the third roller. Such a motion sensor comprises a rack 65 which is integral with a slider 68 designed to support the third roller in a vertical side thereof. The rack 75 meshes a sprocket wheel 63, which is pivoted on a support 64. The sprocket wheel 63 is integral with a slit disk 61 disposed above it. The slit disk 61 is provided circumferentially with slits, e.g. in the number of 75, and rotates by virtue of the rack sprocket wheel unit. The photoelectric counter of this detection system comprises two photoswitches, positioned in a fork 62 and the slit disk 61 passes the gap of the fork 62. The rack 65 can be carried out by photoetching with a pitch e.g. of 3 mm. The sensibility of the detection system can be high as desired by increasing the number of slits of the slit disk (e.g., doubling it to 150 slits). In FIGS. 12 and 13 a slider is indicated as 68; a slider guide is indicated as 68' in the bending head; a shaving plate as 66 and its fixing screws as 66'.

The above described system is a counter of linear displacements.

When the light in the gap of the fork 62 is interrupted during the rotation of the slit disk 61, two phases in quadrature each other are created, allowing the forward/backward counting with a precision e.g. of a tenth of millimeter. Larger are the curves to be performed, greater is the required precision.

The board in FIGS. 11 A–D comprises a section of encoder for the axis X 50, with entrances EC2 8 for the power supply, EC2 7 for the phase 2, EC2 6 for the phase 1 and EC2 5 for the ground; a section 51 of microswitches and foot control with entrances EC2 1 for the return command; EC2 2 for the curve command; EC2 3 for the ground; a section 52 microprogrammed comprising a central processing unit (CPU) 52' e.g., ST6265, a section of operator switch board 53 having as entrances said keys, an output section 54 having exits EC1 5 for the curve exit, EC1 6 for the return exit, EC1 8 for the exit of downstroke and EC1 9 for the exit of upstroke; a section 55 of power supply and LEDs and a display section 56. The section 50 comprises a comparator circuit 50', whose exit $\mathbf{50'}_3$ is connected to an entrance of Not Maskable Interrupt (NMI) of the CPU 52'. The exit $\mathbf{50'}_3$ resets when there is a variation in phase in corrispondance with EC2 6 or EC2 7. This generates a NMI for the state variation at the NMI pin of the CPU. In the program performing the Interrupt the new position is processed and the configuration at the entrance of the comparator circuit 50' is updated in order to detect a new variation in phase.

The electronic board whose circuit diagram is shown in FIG. 11 is programmed in such a way to manage the following functions:

up/down displacement of the axis of the third bender roller, i.e. curving roller;

bending operation to right hand, and bending operation to left hand in connection with the control switchboard as above mentioned, with the four keys "UP/–", "ENTER", "DOWN/+" and "MENU/ESC".

When the system turns ON, the messages "ERCOLINA RC-100" and "Ver [day-month-year]" and then the execution message "RUN" are displayed. Then by pushing "ENTER" key, one goes to a block (3) as above described; vice versa he exits from block pushing "ESC" key, returning to "RUN". If he pushes "MENU" key, he goes to display "EDIT", from which by pushing "ENTER" key he goes to a block (2) as above described, from which he exits to "EDIT" through "ESC". From "EDIT", by pushing "MENU", he goes to the option of setting the reference point "SET REF. POINT", from which by pushing "ENTER" key he goes to a block (1) to be described below, from which he exits through "ESC". From "SET REF. POINT" by pushing "MENU" key he returns to "RUN".

The block (3), as above described, starts with the display "RUN Z", from which, by pushing "ENTER" key, he goes to display "RUN z Syy", from which, by pushing "ENTER" key, he goes to "RUN z Syy xxx.x". From all the last three displays above described one exits to "RUN" pushing "ESC". If from "RUN z" he pushes "+" key, the program number (z) increases. By pushing instead "−" key the program number (z) decreases. On the contrary from "RUN z Syy" by pushing "+" key the step number (yy) increases, by pushing "−" key it decreases. From "RUN z Syy xxx.x" by pushing "ENTER" key he goes to a block (4) to be described below; by pushing "DOWN" key the axis of the third bender roller is moved downward, (only if the height to be reached is below the current position), up to the set height. By pushing "UP" key instead he moves upward the axis of the third bender roller, (only if the height to be reached is above the current position), up to the set height. On the contrary by pushing the foot control connected to the hydraulic unit of the machine (not shown) the axis of the third bender roller is moved toward the height to be reached and, if the direction is downward and it is not the first step in the program (approaching to product), performs also the bending or rolling operation to right hand or left hand alternatively, however the displacement of the axis of the curve roller is apt to the set height. When the set height has been reached, if one does not push "ESC" key to exit, if he pushes "ENTER" key he goes to the block (4), otherwise if he pushes the foot control the rolling or bending operation to right hand and left hand alternatively is performed. By releasing the key or the foot control he returns to "RUN z Syy xxx.x".

The block (4) presents the display "RUN z Syy xxx.x". By pushing "ENTER" key the displayed coordinate in program z step y is stored in permanent memory; by pushing "+" key the program number (z) decreases, by pushing "−" key the step number (yy) decreases. By releasing the key, he returns to display "RUN z Syy xxx.x".

The block (2) starts with the display "EDIT z"; by pushing "ENTER" key he goes to "EDIT.z Syy"; then by pushing "ENTER" key he goes to "EDIT.z Syy xxx.x". From all of these three displays pushing "ESC" he exits to prior display. From "EDIT z" by pushing "+" key the program number (z) increases; by pushing "−" key the program number (z) decreases. From "EDIT.z Syy" by pushing "+" the step number increases, while by pushing "−" key the step number decreases. From "EDIT.z Syy xxx.x" by pushing "ENTER" key the displayed coordinate in the program z step yy is stored in permanent memory, and he returns to "EDIT.z Syy". By pushing "+" key the coordinate (xxx.x) increases, while by pushing "−" key the coordinate (xxx.x) decreases.

The block (1) presents the display "Ref. mm xxx.x", from which by pushing "ENTER" the displayed measure (reference point of the axis of the third bender roller) is reset; by pushing the foot control a rolling operation to right hand or left hand, alternatively, is performed; by pushing "DOWN" key the axis of the third bender roller is moved downward, and by pushing "UP" key the axis of the third bend roller is moved upward. By releasing the key or foot control he returns to display. With "ESC" he exits.

The present invention has been described and shown in relation to its specific embodiment, ma it must be intended that modifications, additions and/or omissions can be apported, without exiting for that from its aim and spirit, as defined by the enclosed claims.

What is claimed is:

1. A bending machine comprising:

a frame having a main side;

a bending head in said main side and including three bender rollers, two rollers of said three bender rollers having fixed axes of rotation, one roller of said three bender rollers having a vertically displaceable axis of rotation and being mounted on a slider which is movable along a vertical rectilinear guide;

a motor and reduction gear unit driving one or more of said bender rollers;

thrust rolls;

a work surface above said bending head; and a reduction gear mounted on said work surface and having means for mechanical connection to said slider for moving said slider vertically along said guide.

2. A bending machine comprising:

a frame having a main side;

a bending head in said main side and including three bender rollers, two rollers of said three bender rollers having fixed axes of rotation, one roller of said three bender rollers having a vertically displaceable axis of rotation and being mounted on a slider which is movable along a vertical, rectilinear guide;

a motor and reduction gear unit driving one or more of said bender rollers;

thrust rolls;

a work surface above said bending head; and a reduction gear mounted on said work surface and having means for mechanical connection to said slider for moving said slider vertically alone said guide, wherein said motor and reduction gear unit drives the two fixed bender rollers by meshing a toothed wheel with two toothed wheels integral in rotation with axes of the fixed bender rollers, one of said toothed wheels being integral in rotation with the axes of the fixed bender rollers and being provided with a clutch means for connecting said one wheel to one end of a first transmission shaft, said first transmission shaft having near its other end sustained by a removable support to said frame, a toothed wheel meshing with another toothed wheel, whose spindle is mounted on a support removably connected to said frame and connected by a universal joint to a second transmission shaft, and said second transmission shaft being connected with a universal joint to another spindle integral in rotation with said third bender roller, in order to transmit the rotary movement from said motor and reduction gear unit to the third bender roller.

3. The bending machine as claimed in claim 2, wherein said supports and said frame have corresponding through holes, and said transmission shaft and said spindle of the other toothed wheel are extended in said through holes to serve as drives of rotary movement for the tools.

4. The bending machine as claimed in claim 1, further comprising means for detecting a position of said supporting slider of the third bender roller along its guide in the bending head.

5. The bending machine of claim 4, further comprising a control unit connected to said slider and said motor and reduction gear unit and a control switchboard and comprising an electronic control card, including means for coding a position along an axis, means for entering commands and means for storing a bending program.

* * * * *